United States Patent [19]

Haemer

[11] 3,947,306

[45] Mar. 30, 1976

[54] METHOD FOR PRODUCING BONDED CARPETING

[75] Inventor: Laurence F. Haemer, Fairfield, N.J.

[73] Assignee: Congoleum Industries, Inc., Kearny, N.J.

[22] Filed: Feb. 20, 1974

[21] Appl. No.: 444,058

[52] U.S. Cl. ..... 156/72; 156/169; 156/173; 156/174; 156/250; 156/251; 428/89; 428/92; 428/95

[51] Int. Cl.[2] ..... B32B 5/00

[58] Field of Search ..... 161/62–67, 161/146, 47; 156/72, 435, 169, 173, 174, 250, 251; 428/89, 92, 95

[56] References Cited

UNITED STATES PATENTS

| | | | |
|---|---|---|---|
| 2,904,871 | 9/1959 | Wolff | 161/65 |
| 3,271,216 | 9/1966 | Koller | 156/72 |
| 3,574,107 | 4/1971 | Hurka | 161/62 |
| 3,755,051 | 8/1973 | Stumpf | 161/63 |

*Primary Examiner*—Marion E. McCamish
*Attorney, Agent, or Firm*—Richard T. Laughlin

[57] ABSTRACT

A method for producing carpeting of type having pile yarns adhesively bonded to a backing which comprises providing a thin flexible core member having longitudinal and transverse axes, winding a continuous yarn around the core member in a direction perpendicular to the longitudinal axis so as to form a plurality of elongated loops conforming to the cross-sectional configuration of the core member, positioning the core member having the yarn wound thereon on a backing sheet so that the longitudinal axis is parallel to the sheet and the transverse axis is perpendicular to the sheet and so that one end of each of the loops contacts the backing sheet, adhering the end of the loops contacting the backing sheet to the backing sheet, cutting the other ends of the loops, and removing the core member.

11 Claims, 12 Drawing Figures

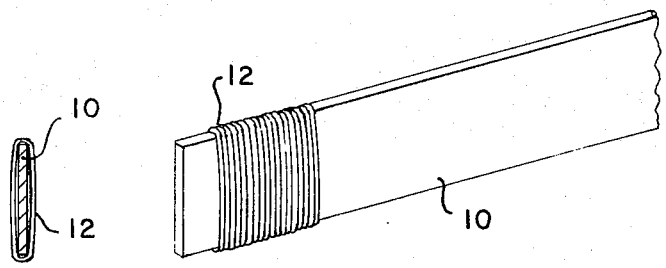
Fig. 2
Fig. 1
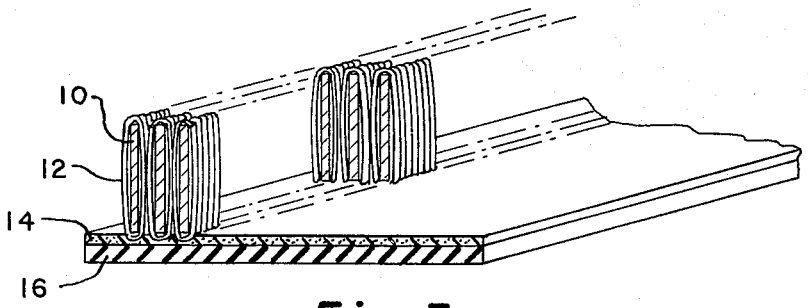
Fig. 3
Fig. 4
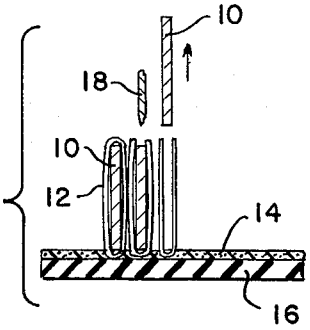
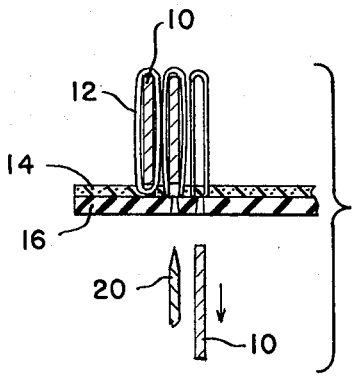
Fig. 5
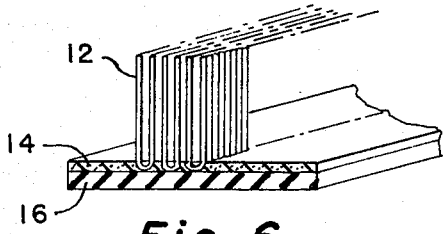
Fig. 6
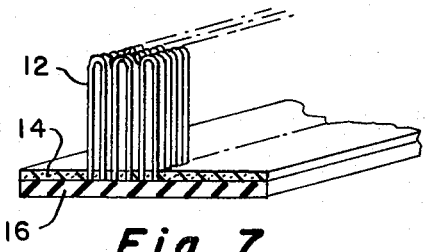
Fig. 7

METHOD FOR PRODUCING BONDED CARPETING

This invention relates to the method for producing pile carpeting, and more particularly, the invention relates to a method for producing bonded carpeting.

The most common type of carpeting presently available is the so-called "tufted" carpeting. Such carpeting consists of typically a woven backing sheet having piles or tufts of yarn secured thereto. One end of the tufts is generally secured to the backing sheet, while the other end extends through the backing sheet and a desired distance above the backing sheet to serve as the visible portion of the carpet. Such carpeting is popular particularly from the standpoint of ease of manufacture. The manufacture of such carpeting is carried out on a machine which uses needles to push the yarns through the backing sheet, similarly to weaving, leaving a loop or tuft projecting up through the sheet.

Tufted carpeting may be given different decorative appearances by a number of techniques. Typically, the yarn used for the production of such carpeting is dyed and may be dyed before the carpeting is made or after the carpeting is made by padding or other dyeing techniques.

Loops are easily formed with a continuous yarn being needled to the backing sheet, and thus loop-pile carpeting is formed. If these loops are then cut, "cut-pile" carpeting is produced.

This type carpeting may be further enhanced from a decorative standpoint by treating certain of the yarns in a predetermined pattern with a material which causes shrinking of the yarns contacted therewith, thereby producing a sculptured or textured appearance on the surface of the carpeting. The treating material may be applied simultaneously with dyes for producing a sculptured appearance in register with different color patterns.

Bonded carpeting does not use a backing sheet which is needled with the yarn, but instead, carries an adhesive substance which bonds the yarns to the backing sheet. Bonded carpeting may be characterized by two major categories:

1. Single end implantation, and
2. Multiple fold implantation

Single end implantation refers to a single strand of yarn which is implanted on an adhesive backing, while multiple fold implantation is characterized by a folding or pleating of the yarns to a wavy configuration with subsequent implantation of the bottoms of the waves in the adhesive backing.

Many variations of each of these two types of bonding techniques are found in the prior art, and they suffer from many disadvantages. For example, the loop pile which may be formed by a multiple fold implantation process results in a single, continuous yarn being used for many loops. Thus, if one loop is snagged, the yarn may pull out from the entire carpeting. Single end implantation generally requires more complex machinery, and thus the commerical feasibility of such systems is reduced.

The present invention provides a versatile method for producing bonding carpeting which is not, strictly speaking, of either the single end implantation type, nor the multiple fold type, but may be broadly considered as a hybrid of these two prior art methods of bonded carpet production.

Accordingly, it is a primary object of this invention to provide an improved method for the production of bonded carpeting.

Another object of this invention is to provide a method for producing bonded carpeting with greatly improved versatility.

A further object of this invention is to provide a method for producing bonded carpeting of either the loop-pile or cut-pile types.

Still another object of this invention is to provide a method for producing bonded carpeting which may have a sculptured appearance.

Still a further object of this invention is to provide a method for producing bonded carpeting which may utilize different colored yarns in a given row of piles.

Yet another object of this invention is to provide a method for producing bonded carpeting which may be dyed with a number of different dyeing techniques to permit great versatility in producing carpeting having greater appeal.

Still another object of this invention is to provide a method for producing bonded carpeting which does not require complex machinery for carrying out the method.

Yet a further object of this invention is to provide a method for producing carpeting wherein the yarn may be printed with dyes to produce any desired pattern.

Still a further object of this invention is to provide an improved method for producing a sculptured carpeting having a dyed pattern in register with the sculpturing.

These and other objects and advantages of this invention will become apparent when considered in light of the following description and claims when taken together with the accompanying drawings in which:

FIG. 1 is a perspective view of one of the core elements used in the present invention;

FIG. 2 is an end of the element of FIG. 1;

FIG. 3 is a perspective view showing the assembly of the core elements of FIG. 1 to a backing sheet;

FIG. 4 is a schematic view illustrating the removal of the core element;

FIG. 5 is a schematic illustration showing an alternate method for removing the core element;

FIG. 6 is a perspective view of a section of carpeting produced from FIG. 4;

FIG. 7 is a view similar to FIG. 6, however showing carpeting produced according to FIG. 5;

DESCRIPTION OF FIGS. 1–3

Figure 9:
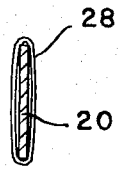
FIG. 9 is an end view of the element of FIG. 8.

With reference now to FIGS. 1–3, a core element 10 is shown. Element 10 is a thin, flexible strip of metal or other suitable strong material. Typically, the strip would be approximately one half to 1 inch high and sufficiently thin to provide good flexibility with the thickness being dependent upon the particular material of the core element. The element 10 may be of any desired length such as for example, 100 feet or more, and may be wound on a spool for storage prior to use.

A continuous yarn 12 is wound around the core member 10 in a continuous fashion as shown, covering substantially the entire length thereof. The yarn need not be wound extremely tight, but should be uniformally wound so that it will retain its position and shape on the element 10.

The strip 10 with the yarn 12 wound thereon may also be coiled on a spool for storage purposes prior to being made into a carpet.

A plurality of strips 10 having yarn 12 wound thereon are prepared and the number of strips required will depend on the width of the carpeting and the spacing between the tufts across this width. The spacing between adjacent wraps of yarn on the element 10 controls the spacing of the tufts in the longitudinal direction of carpeting.

After the strips have been wound with the yarn, the yarn may be printed with dyes to produce any desired pattern. The pattern may be in register on adajcent strips or may be random, or may be merely a solid color. It is also possible to print different colors at different heights of the pile producing an effect similar to space dying of yarn, but with the design being reproducible rather than random.

The elements 10 having the yarn 12 wound thereon are then placed with their transverse axis vertical and their longitudinal axes horizontal so that one of the edges of the element 10 contacts an adhesive material 14 on a backing sheet 16 so that the bottom of the loops of the yarn 12 around the core 10 is embedded in the adhesive 14. A plurality of the core elements 10 are positioned in a parallel manner on the adhesive coated backing in a manner shown in FIG. 3. Although only three core elements are shown in FIG. 3, it is understood that a sufficient number of such elements is used to cover the width of the backing 16 at the desired spacing.

The adhesive used is not critical to this invention, however, it may preferably be a hot extruded plastic sheet, a plastisol which is subsequently gelled and fused, a hot melt coating, a foam which is subsequently gelled and cured, etc., depending upon the type of backing desired. The adhesive and the backing need not be separate elements since if a thermoplastic material is used as the backing, it may likewise serve as the adhesive.

DESCRIPTION OF FIGS. 4–7

In order to remove the core elements 10, it is necessary that the yarn 12 which is wrapped therearound be severed. In order to accomplish this, the carpeting may be passed beneath a suitable knife 18 as seen in FIG. 4 which cuts the tops of the loops of the yarn 12, after which the core elements 10 may be easily removed. In this manner, a cut-pile carpeting as seen in FIG. 6 is produced.

Alternatively, if a loop pile carpeting is desired, the bottoms of the loops of the yarn 10 are severed by a knife 20 which passes through the backing sheet 16 and the adhesive layer 14 to sever the yarn. Subsequently, the core element 10 is withdrawn through the backing sheet. For this embodiment, a thermoplastic backing sheet is used, the cuts are resealed by reheating the backing to fuse it together. Alternatively, the cuts may be resealed by applying an additional layer of backing material and adhesively securing it or fusing it to the original backing sheet.

In this embodiment, a loop pile type carpeting as seen in FIG. 7 is produced. Whereas in prior art types of loop pile carpeting, the loops are formed from a continuous yarn, the loops formed according to the present invention are individual, and thus snagging of one loop, will only pull out that loop, and no others. This is a distinct advantage over prior art loop pile carpeting, either of the bonded or tufted type.

DESCRIPTION OF THE ALTERNATE EMBODIMENT OF FIGS. 8–12

Since it is apparent that the height of the pile of the carpeting in all embodiments is essentially equal to the width of the core elements 10, and thus the pile height may vary according to the desired type of carpeting being produced, a sculptured pile carpet may be produced by this invention.

Figure 8:
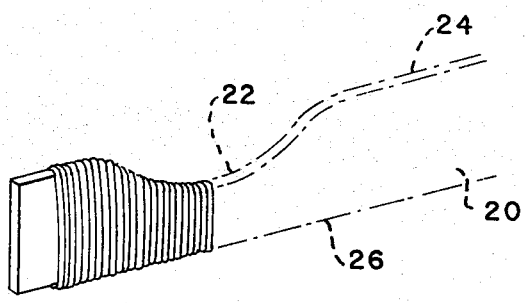
FIG. 8 is a perspective view of an alternate core member used in this invention.

FIG. 8 discloses an alternate embodiment of this invention wherein a core element 20 is provided and has a section 22 of reduced height. The top edge 24 may be patterned to any extent desired, but the bottom edge 26 should be substantially straight. Yarn 28 is wound continuously around the core element 20 in a manner similar to that of FIG. 1 and extends from one end of the strip to the other.

Figure 10:
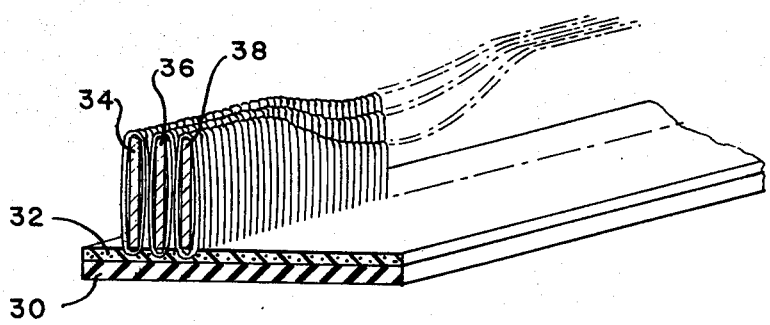
FIG. 10 is a perspective view of a plurality of core members similar to FIG. 8 in assembled relationship.

A plurality of yarn-wound strips are then assembled in a manner similar to that of FIG. 3. As seen in FIG. 10, a backing sheet 30 is provided with an adhesive coating 32, but clearly, the backing sheet and adhesive may be an integral single layer component as discussed previously. A plurality of different core elements 34, 36 and 38 are brought into an assembled relationshio as shown in FIG. 10, and pressed into the adhesive material so that the bottoms of the loops of yarn 28 are pressed into the adhesive by the straight edges of the core elements and embedded therein.

Figure 11:
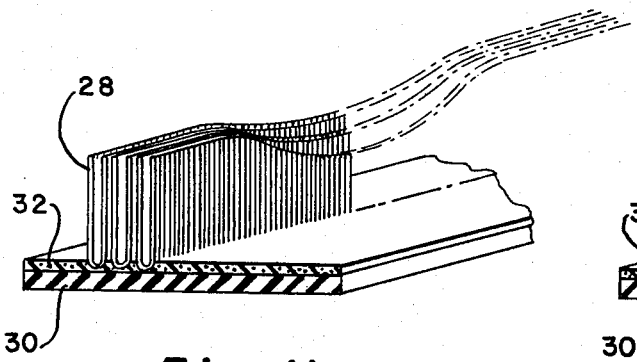
FIG. 11 is a perspective view of one type of carpeting made according to FIG. 10.
Figure 12:
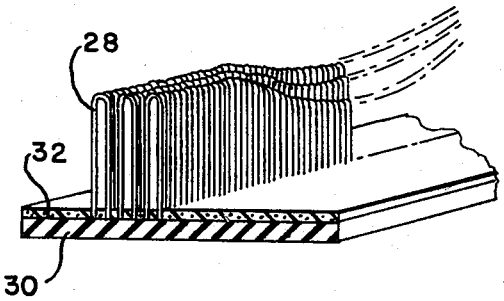
FIG. 12 is a perspective view of a second type of carpeting made from the assembly of FIG. 10.

Next, after the adhesive has set, the loops of the yarn around the core elements 34, 36 and 38 are severed either at the top of the loops in a manner similar to that of FIG. 4, or at the bottoms of the loops in a manner similar to that of FIG. 5. The resultant products are shown in FIGS. 11 and 12 respectively, which disclose a cut pile or loop pile textured or sculptured carpeting.

It is also possible to use pre-dyed yarns for winding on the core elements. Also, several different yarns can be used on the same core element retaining the colors which do not show at a particular spot near the base of the core element and interchanging the winding yarn colors as desired. Thus two or more different colored yarns could be carried on the core elements at a given time and all or less than all of the yarns would be wound about the element at a particular point.

With the possible variations in the heights of the core elements along their length, and the ease of dyeing the yarns in different manners, great variety may be achieved in the carpeting produced according to the present invention.

A further advantage of the present invention arises when dyeing the yarns after they have been wound upon the core element strips. Since only the thickness of the yarn as opposed to the length of the pile, has to be penetrated by the dye, there is no limitation on pile height as there is in present printing methods. Further, this method also allows printing a given tuft of pile with different colors and different heights of the pile in a reproducible pattern, thereby permitting production of effects not available by present techniques.

Another significant advantage of this embodiment is that the carpeting may be produced with a printed dyed pattern in good register with the sculpturing. This is particularly easy to do if sharp shouldered contours are used for the sculptured effect since the shoulders can act as registration points for the printing of the dye.

Further, soft bulky yarns which could not be tufted can be used in the present process, since the tension required in winding on the forms is much less than that required to tuft a heavy yarn.

While this invention has been described, it will be understood that it is capable of further modification, and this application is intended to cover any variations, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. A method for producing carpeting of the type having pile yarns adhesively secured to a backing comprising:

a. providing a thin flexible core member having longitudinal and transverse axes, b. winding a continuous yarn around said core member substantially perpendicularly to said longitudinal axis so as to form a plurality of elongated loops conforming to the cross-sectional configuration of said core member, c. positioning said core member having said yarn wound thereon on a backing sheet so that said longitudinal axis is parallel to said sheet and said transverse axis is perpendicular to said sheet and one end of each of said loops contacts said backing sheet, d. adhering said one end of said loops to said backing sheet, e. cutting the other ends of said loops, and f. removing said core member.

2. A method as in claim 1 and including:

adhering said ends of said loops with a thermosensitive adhesive.

3. A method as in claim 1 and wherein:

said backing sheet is formed from a thermosensitive resinous material to which said yarn adheres.

4. A method as in claim 1 and including:

a. providing a plurality of said core member, and b. positioning said strips on said backing sheet so that said core members are substantially parallel.

5. A method as in claim 4 and wherein:

a. each of said core member has one substantially straight edge, and b. at least some of said core members have their other edge contoured, c. thereby producing carpeting having a sculptured appearance.

6. A method for producing loop pile carpeting having individual pile loops adhesively secured to a backing comprising:

a. providing a thin flexible core member having longitudinal and transverse axes, b. winding a continuous yarn around said core member substantially perpendicularly to said longitudinal axis so as to form a plurality of elongated loops conforming to the cross-sectional configuration of said core member, c. positioning said core member having said yarn wound thereon on a thermoplastic backing sheet so that said longitudinal axis is parallel to said sheet and said transverse axis is perpendicular to said sheet and one end of each of said loops contacts said backing sheet, d. adhering said one end of said loops to said backing sheet, e. cutting said one end of said loops by means of a cutter passing through said backing sheet, f. removing said core member through said backing sheet, and g. heating said backing sheet at least in the area of the cut for fusing said cut backing sheet together.

7. A method as in claim 6 and wherein:

said loops are adhered to said thermoplastic backing sheet during said heating step.

8. A method as in claim 6 and including:

adhering said loops to said backing sheet by means of a thermosensitive adhesive.

9. A method as in claim 6 and including:

a. providing a plurality of said core members, and b. positioning said core members on said backing sheet so that said core members are substantially parallel.

10. A method as in claim 9 and wherein:

a. each of said core members have one substantially straight edge, and b. at least some of said core members have a contour on their other edge, c. thereby producing carpeting having a sculptured appearance.

11. A method for producing carpeting of the type having pile yarns adhesively secured to a backing comprising:

a. providing a thin flexible core member having longitudinal and transverse axes, b. winding a continuous yarn around said core member substantially perpendicularly to said longitudinal axis so as to form a plurality of elongated loops conforming to the cross-sectional configuration of said core member, c. positioning said core member having said yarn wound thereon on a backing sheet so that said longitudinal axis is parallel to said sheet and said transverse axis is perpendicular to said sheet and one end of each of said loops contacts said backing sheet, d. adhering said one end of said loops to said backing sheet, e. cutting one end of each of said loops, and f. removing said core member.

* * * * *